US007261020B2

(12) United States Patent
Hsieh

(10) Patent No.: US 7,261,020 B2
(45) Date of Patent: Aug. 28, 2007

(54) CLAMPING DEVICE FOR PROVIDING HIGH TWISTING FORCES AND LOW DAMAGE TO SCREW DEVICE

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/512,131

(22) Filed: Aug. 30, 2006

(65) Prior Publication Data

US 2006/0288824 A1 Dec. 28, 2006

Related U.S. Application Data

(63) Continuation-in-part of application No. 11/031,654, filed on Jan. 7, 2005, now abandoned.

(51) Int. Cl.
*B25B 13/06* (2006.01)

(52) U.S. Cl. ..... 81/121.1; 81/186

(58) Field of Classification Search ..... 81/121.1, 81/186, 119, 124.6
See application file for complete search history.

(56) References Cited

U.S. PATENT DOCUMENTS 3,909,764 A * 9/1975 Andersen ..... 81/121.1
4,126,063 A * 11/1978 Palmer ..... 81/124.6
5,117,714 A * 6/1992 Pagac et al. ..... 81/119
5,476,024 A * 12/1995 Hsieh ..... 81/121.1
5,832,792 A * 11/1998 Hsieh ..... 81/124.6
5,860,339 A * 1/1999 Mikic et al. ..... 81/186
5,904,076 A * 5/1999 Siwy ..... 81/121.1
6,029,548 A * 2/2000 Hsieh ..... 81/166
6,098,501 A * 8/2000 Sundstrom ..... 81/121.1
2004/0221688 A1* 11/2004 Liao ..... 81/121.1
2006/0156869 A1* 7/2006 Hsieh ..... 81/121.1

* cited by examiner

*Primary Examiner*—David B. Thomas

(57) ABSTRACT

A clamping device for providing high twisting forces and low damage to a screw device comprises a handle; a driving portion formed with a space; the space including at least two resisting portions and at least two adhesion portions; the resisting portions and adhesion portions being alternatively arranged; each of the connection of the resisting portion and the adhesion portion being formed with a recess for receiving apexes of a screw means so as to prevent the screw means from damage; and each resisting portion having two cambered protrusions at two ends and three sharp teeth between the two cambered protrusions; the apexes of cambered protrusions and sharp teeth being collinear. Furthermore, the driving portion of the present invention can be used to a sleeve so that sleeve has the same function of the driving portion. Thereby it is preferred that there are three resisting portions and three adhesion portions.

2 Claims, 4 Drawing Sheets

CLAMPING DEVICE FOR PROVIDING HIGH TWISTING FORCES AND LOW DAMAGE TO SCREW DEVICE

The present invention is a continuation in part (CIP) of U.S. patent Ser. No. 11/031,654, filed Jan. 7, 2005, now abandoned, assigned and invented by the applicant of the present invention. Thus, the content of the application U.S. patent Ser. No. 11/031,654 is incorporated into the present invention as a part of the present invention.

FIELD OF THE INVENTION

The present invention relates to a clamping device for providing high twisting forces and low damage to a screw device, wherein the apexes of the screw means will be received in the recesses of the clamping device, while the flat surfaces tightly resisting against the resisting portions of the clamping device will increase the friction force. Thereby the hexagonal screw means can drive easily.

BACKGROUND OF THE INVENTION

There are many improvements for improving the twisting force of a sleeve device or a spanner. In one prior art, the inner side of the sleeve (or the driving portion of the spanner) is teethed so as to increase the friction force between the inner side of the sleeve (the driving portion) and screw means located therein. However the teeth are damaged at the apexes, they cannot suffer from a larger twisting force. As it is used for a longer time, the sleeve (or spanner) will be destroyed.

In another improvement, each of the connection of two inner sides of the sleeve (or driving portion of a spanner) is formed with a recess for firmly securing the apexes of a screw means. However if a larger force is applied thereon, the apexes will be destroyed, and thus it is not an ideal design.

SUMMARY OF THE INVENTION

Accordingly, the primary object of the present invention is to provide a clamping device for providing high twisting forces and low damage to a screw device, wherein the apexes of the screw means will received in the recesses of the clamping device, while the flat surfaces tightly resisting against the resisting portions of the clamping device will increase the friction force. Thereby the hexagonal screw means can drive easily.

To achieve above objects, the present invention provides a clamping device for providing high twisting forces and low damage to a screw device. The device comprises a handle; a driving portion formed with a space; the space including at least two resisting portions and at least two adhesion portions; the resisting portions and adhesion portions being alternatively arranged; each of the connection of the resisting portion and the adhesion portion being formed with a recess for receiving an apex of a screw means so as to prevent the screw means from damage; and each resisting portion having two cambered protrusions at two sides and three sharp teeth between the two cambered protrusions; the apexes of cambered protrusions and sharp teeth being collinear. Furthermore, the driving portion of the present invention can be used to a sleeve so that sleeve has the same function of the driving portion. Thereby it is preferred that there are three resisting portions and three adhesion portions.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
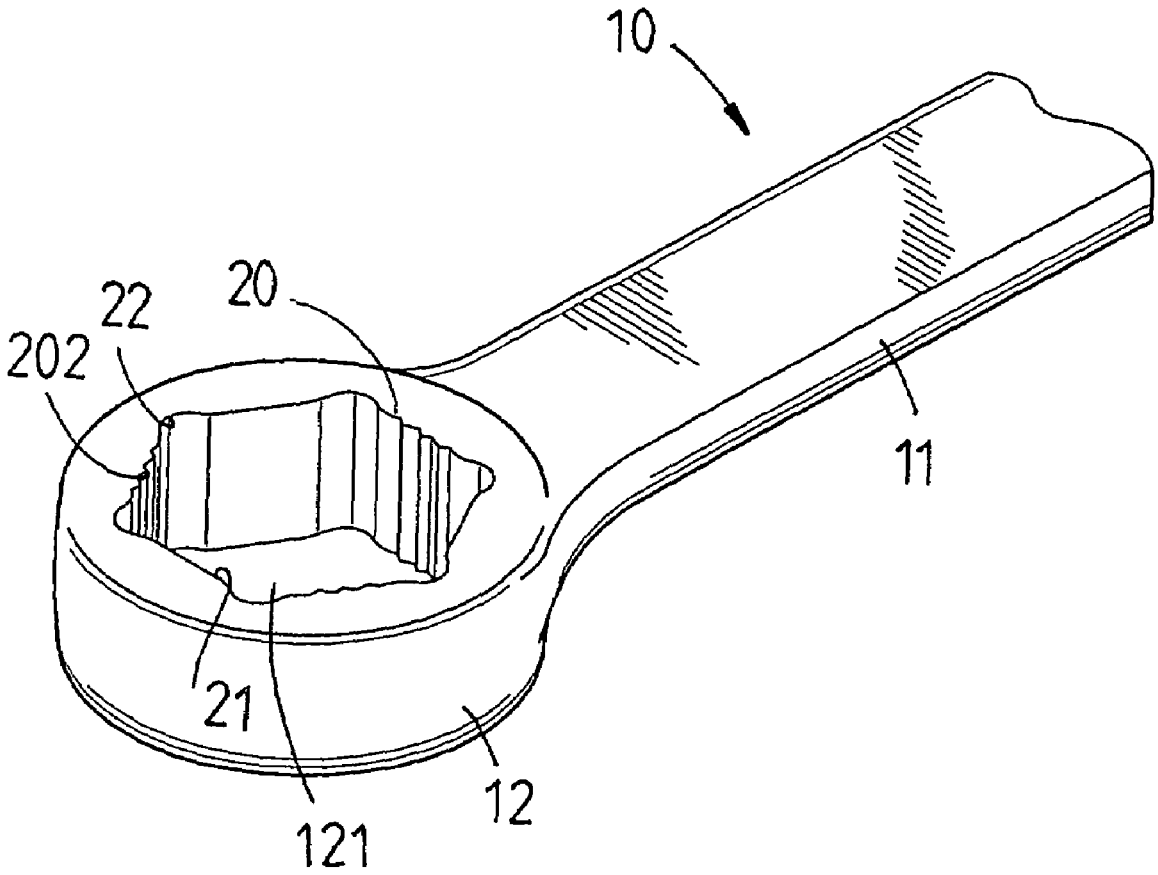
FIG. 1 is a schematic view of the present invention.
Figure 2:
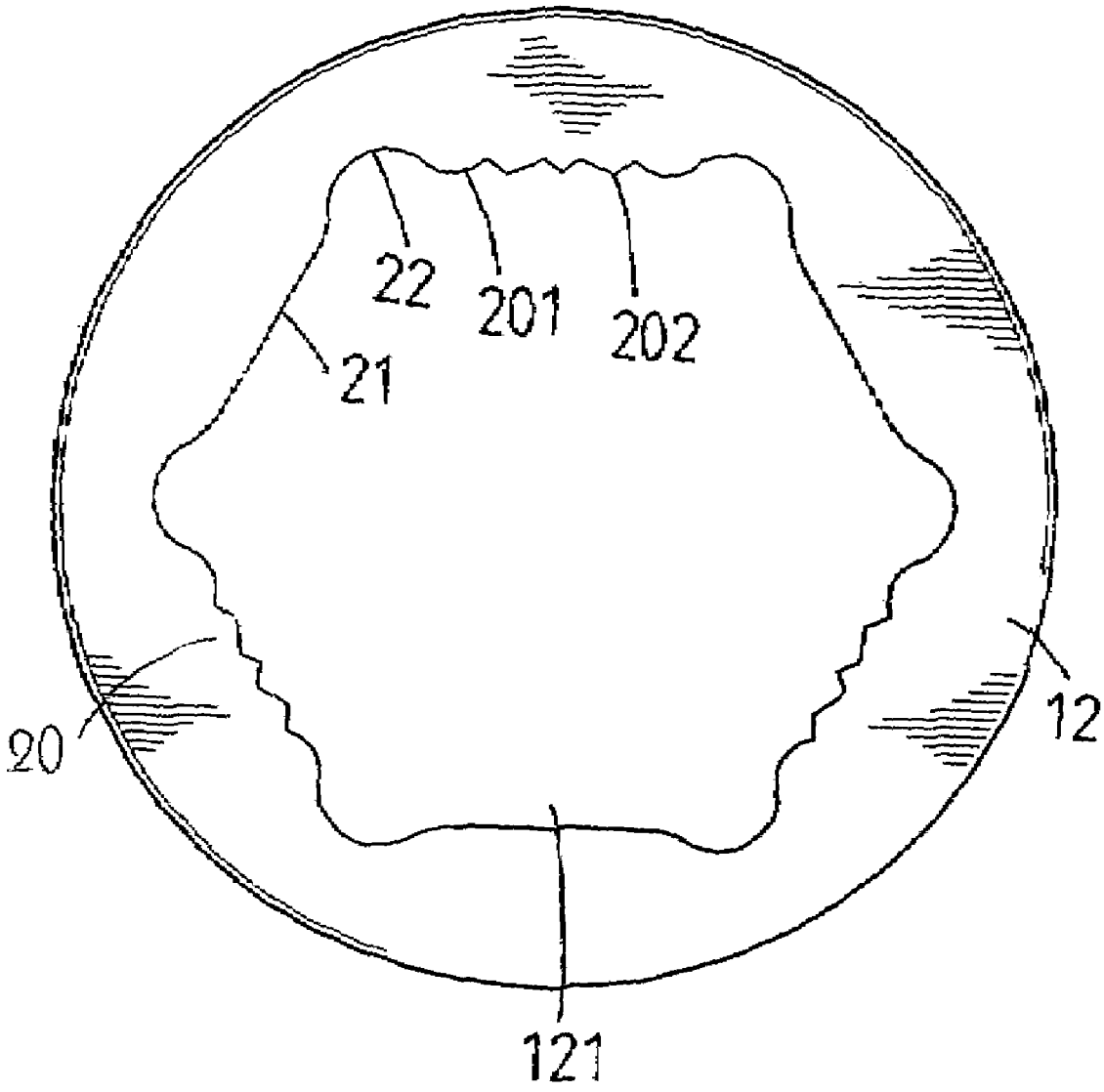
FIG. 2 is a schematic view about the driving portion of the present invention.

With reference to FIGS. 1 and 2, the structure of the present invention is illustrated. The present invention is aimed at general used driving means, such as ring spanners, ratchet spanners, or sleeve spanners, etc.

The present invention has the following elements.

A body 10 has a handle 11 and driving portion 12.

The driving portion 12 is formed with an inner hexagonal space 121. The hexagonal space 121 includes three resisting portions 20 and three adhesion portions 21. The resisting portions 20 and adhesion portions 21 are alternatively arranged. Each of the connection of the resisting portion 20 and the adhesion portion 21 is formed with a recess 22 for receiving apex of a hexagonal screw means so as to prevent the screw means from damage.

Figure 3:
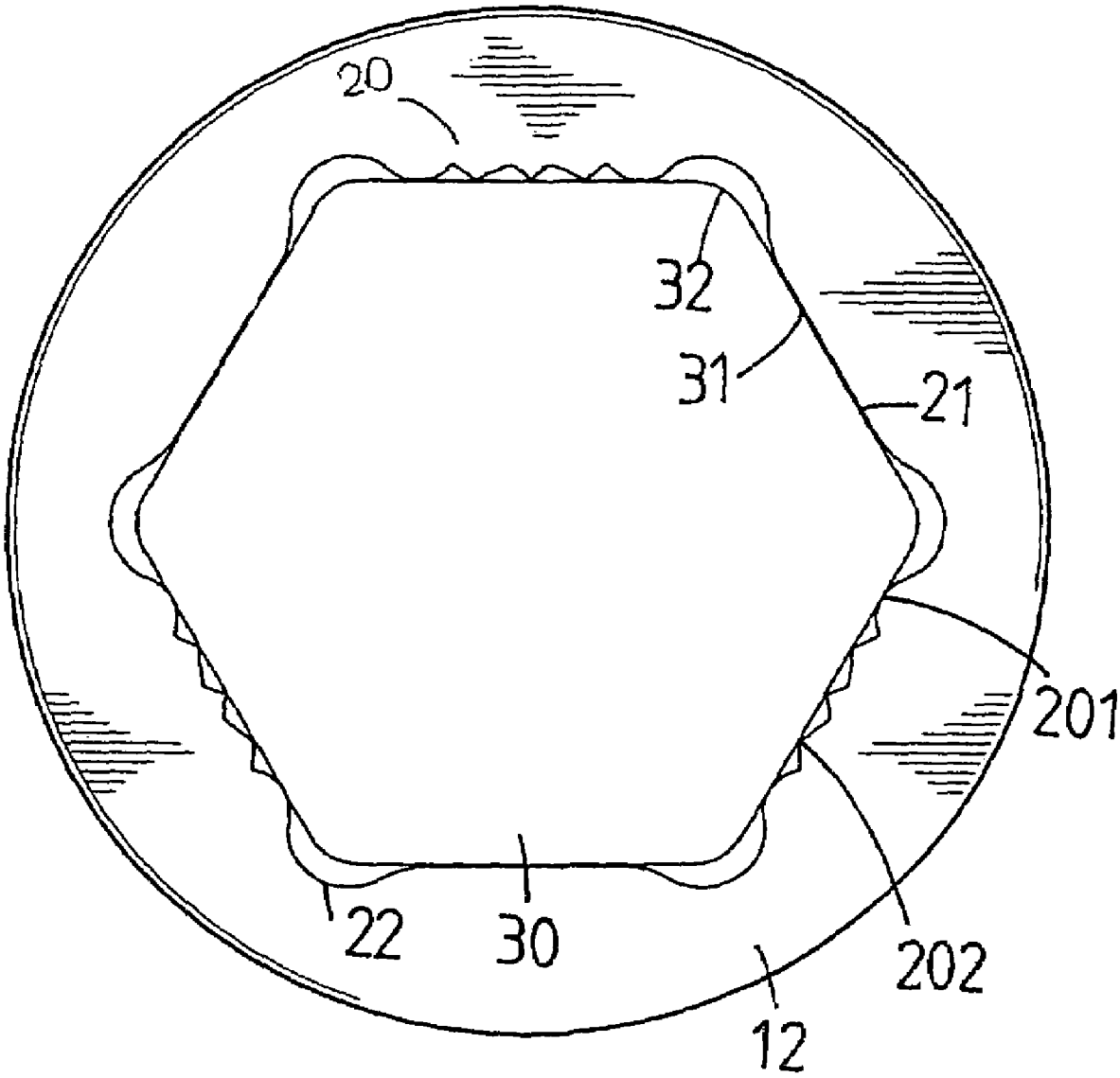
FIG. 3 is a schematic view about the engagement of the present invention.

In the present invention, referring to FIGS. 1 and 3, it is illustrated that each resisting portion 20 has two cambered protrusions 201 at two ends and three sharp teeth 202 between the two cambered protrusions 201. The apexes of cambered protrusions 201 and sharp teeth 202 are collinear.

With reference to FIG. 3, when a hexagonal screw means 30 is received within the hexagonal space 121. The flat adhesion portions 21 will completely adhere to the three flat surfaces 31 of the screw means 30 with a larger area. The other three flat surfaces 31 tightly resist against the cambered protrusions 201 and the sharp teeth 202. Thereby the twisting force from the spanner to the screw means 30 is increased.

Thereby in the present invention, the apexes of the screw means 30 will be received in the recesses, while the three flat surfaces 31 tightly resisting against the cambered protrusions 201 and the sharp teeth 202 will increase the friction force. Thereby the hexagonal screw means 30 can drive easily.

Figure 4:
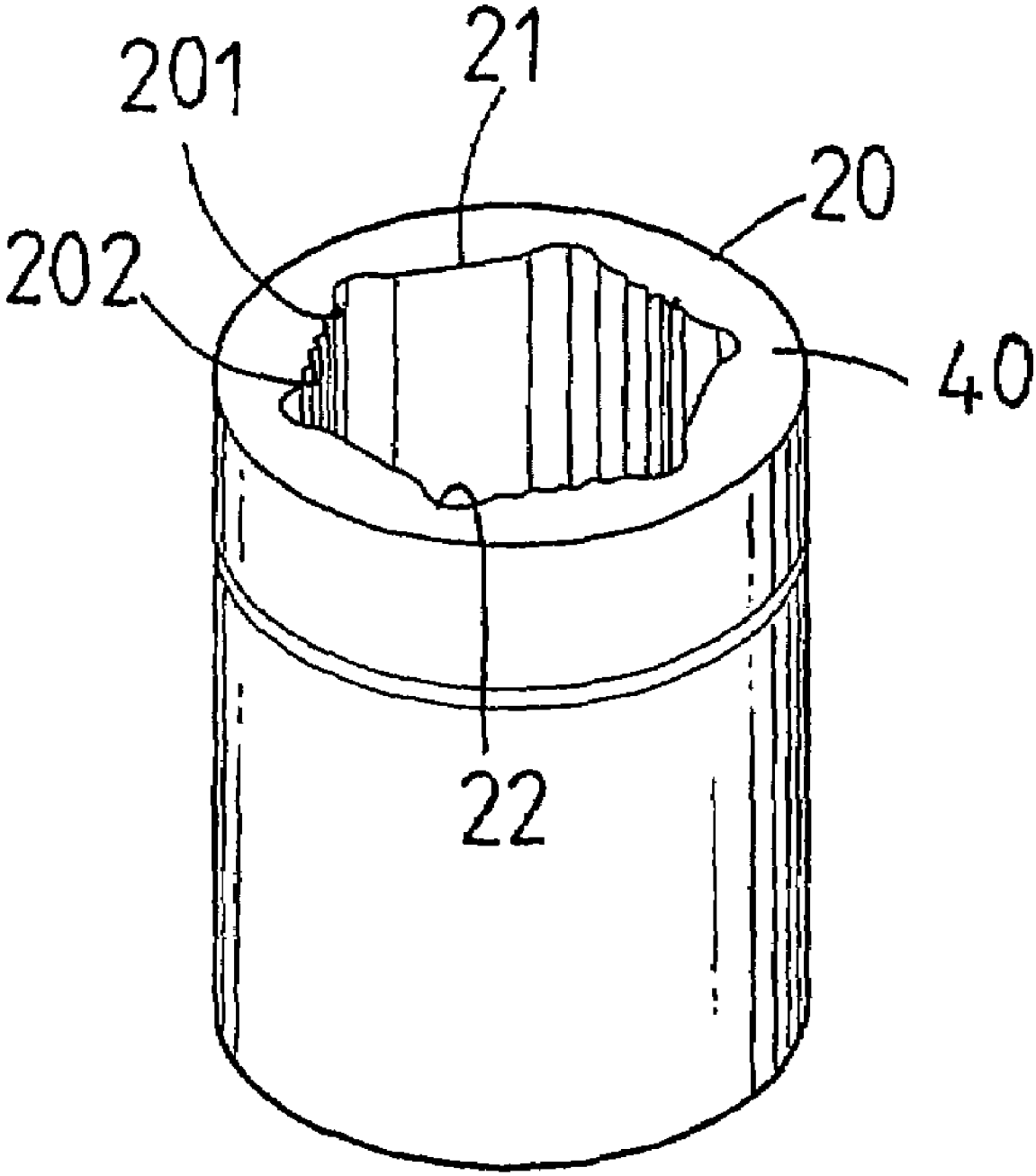
FIG. 4 shows that the present invention is applied to a sleeve.

Referring to FIG. 4, it is illustrated that the present invention is used to a sleeve 40. A sleeve 40 is formed with a hexagonal space 121. The hexagonal space 121 includes three resisting portions 20 and three adhesion portions 21. The resisting portions 20 and adhesion portions 21 are alternatively arranged. Each of the connection of the resisting portion 20 and the adhesion portion 21 is formed with a recess 22 for receiving an apex of a hexagonal screw means so as to prevent the screw means from damage. Each resisting portion 20 has two cambered protrusions 201 at two ends and three sharp teeth 202 between the two cambered protrusions 201. The apexes of cambered protrusions 201 and sharp teeth 202 are collinear.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. clamping device for providing high twisting forces and low damage to a screw device comprising:

a handle;

a driving portion formed with a hexagonal space; the hexagonal space including three resisting portions and three adhesion portions; the resisting portions and adhesion portions being alternatively arranged; each of the connection of the resisting portion and the adhesion portion being formed with a recess for receiving an apex of a screw means so as to prevent the screw means from damage; and thus there being totally six recesses in apexes of the hexagonal space, and each resisting portion having two cambered protrusions at two sides and three sharp teeth between the two cambered protrusions; the apexes of cambered protrusions and sharp teeth being collinear;

wherein the driving portion is an integral structure and the handle and the driving portion are integrally formed.

2. A clamping device for providing high twisting forces and low damage to a screw device comprising:

a sleeve having a hexagonal space; the hexagonal space including three resisting portions and three adhesion portions; the resisting portions and adhesion portions being alternatively arranged; each of the connection of the resisting portion and the adhesion portion being formed with a recess for receiving an apex of a screw means so as to prevent the screw means from damage; and thus there being totally six recesses in apexes of the hexagonal space, and each resisting portion having two cambered protrusions at two sides and three sharp teeth between the two cambered protrusions; the apexes of cambered protrusions and sharp teeth being collinear;

wherein the sleeve is an integral structure.

* * * * *